US010113789B2

(12) United States Patent
Yu et al.

(10) Patent No.: US 10,113,789 B2
(45) **Date of Patent: *Oct. 30, 2018**

(54) REFRIGERATOR

(71) Applicant: LG ELECTRONICS INC., Seoul (KR)

(72) Inventors: Seonil Yu, Seoul (KR); Hongsik Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/516,925

(22) PCT Filed: Oct. 19, 2015

(86) PCT No.: PCT/KR2015/011036
§ 371 (c)(1),
(2) Date: Apr. 5, 2017

(87) PCT Pub. No.: WO2016/060531
PCT Pub. Date: Apr. 21, 2016

(65) Prior Publication Data

US 2017/0299256 A1 Oct. 19, 2017

(30) Foreign Application Priority Data

Oct. 17, 2014 (KR) ..... 10-2014-0140653

(51) Int. Cl.
*F25D 25/02* (2006.01)
*F25D 23/04* (2006.01)

(52) U.S. Cl.
CPC ..... *F25D 25/027* (2013.01); *F25D 23/04* (2013.01); *F25D 2323/023* (2013.01)

(58) Field of Classification Search
CPC .. F25D 25/02; F25D 25/027; F25D 2323/023; F25D 2325/021; F25D 23/04; F25D 23/028; A47B 46/00; A47B 46/005
See application file for complete search history.

(56) References Cited

U.S. PATENT DOCUMENTS 2,062,360 A * 12/1936 Goulooze ..... F25D 25/02 126/340
2,112,771 A * 3/1938 Goulooze ..... F25D 23/04 218/8

(Continued)

FOREIGN PATENT DOCUMENTS

JP 03158691 A * 7/1991 ..... F25D 23/04
KR 2010036600 A 4/2010

(Continued)

OTHER PUBLICATIONS

International Search Report in International Application No. PCT/KR2015/011036, dated Jan. 12, 2016, 2 pages.

(Continued)

*Primary Examiner* — Andrew M Roersma
(74) *Attorney, Agent, or Firm* — Fish & Richardson P.C.

(57) ABSTRACT

According to an embodiment of the present invention, a refrigerator includes: a cabinet forming a storage space; a first door rotatably coupled to a front surface of the cabinet to open or close the storage space, and having an open portion formed therein; a second door rotatably connected to the first door at a front surface of the first door; a shelf rotatably mounted in the open portion; and a connection module provided in the first door and connected to a rotary shaft of the shelf to enable the shelf to be unfolded forward when the second door is opened and to stand to be folded when the second door is closed.

10 Claims, 8 Drawing Sheets

(56) References Cited

U.S. PATENT DOCUMENTS

| | | | | |
|---|---|---|---|---|
| 8,322,805 | B2 * | 12/2012 | Kwon | F25D 23/025 312/275 |
| 8,851,589 | B2 * | 10/2014 | Gwak | F25D 23/04 312/292 |
| 2007/0012637 | A1 | 1/2007 | Yu et al. | |
| 2008/0034778 | A1 | 2/2008 | Lim et al. | |
| 2008/0302397 | A1 * | 12/2008 | Buhlmeyer | A47L 15/502 134/85 |
| 2010/0308705 | A1 | 12/2010 | Kwon et al. | |
| 2013/0081423 | A1 | 4/2013 | Kwon et al. | |
| 2016/0273825 | A1 * | 9/2016 | Lim | F25D 23/025 |

FOREIGN PATENT DOCUMENTS

| | | |
|---|---|---|
| KR | 10-2012-0017855 | 2/2012 |
| KR | 10-2013-0052092 | 5/2013 |
| KR | 10-2013-0143367 | 12/2013 |

OTHER PUBLICATIONS

European Extended Search Report in European Application No. 15850110.6, dated Apr. 24, 2018, 8 pages.

* cited by examiner

【Figure 1】
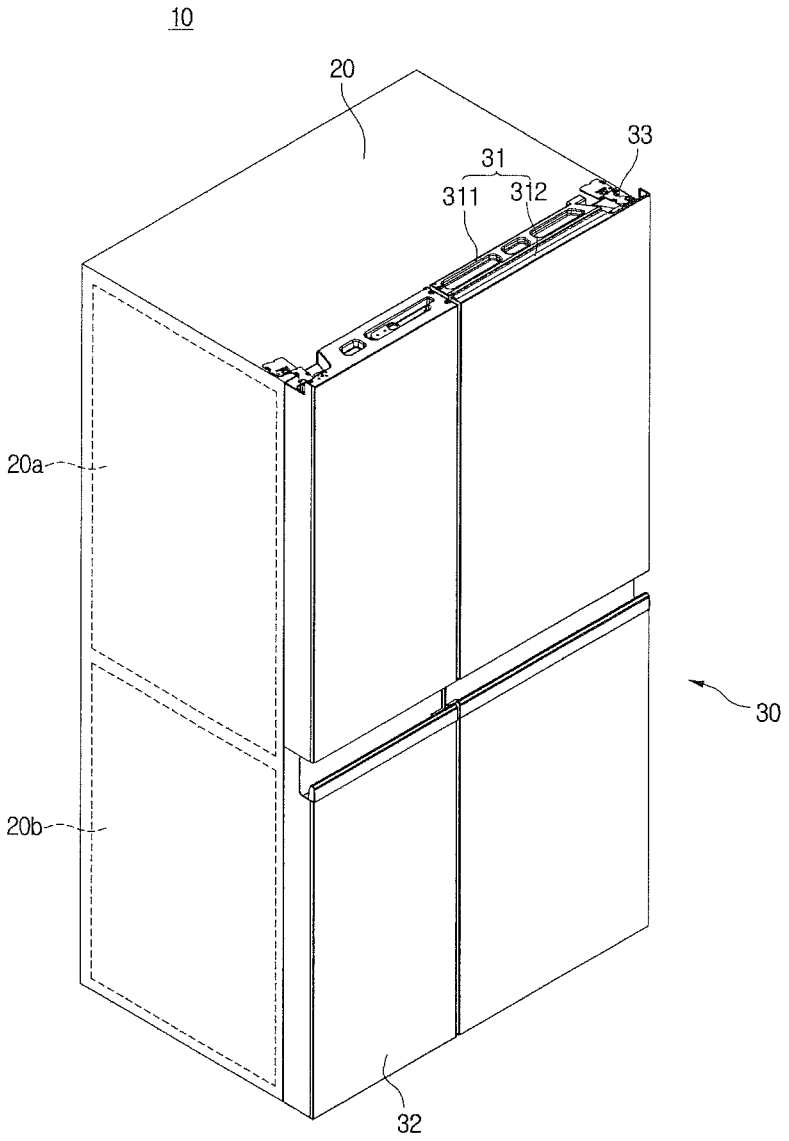

【Figure 2】
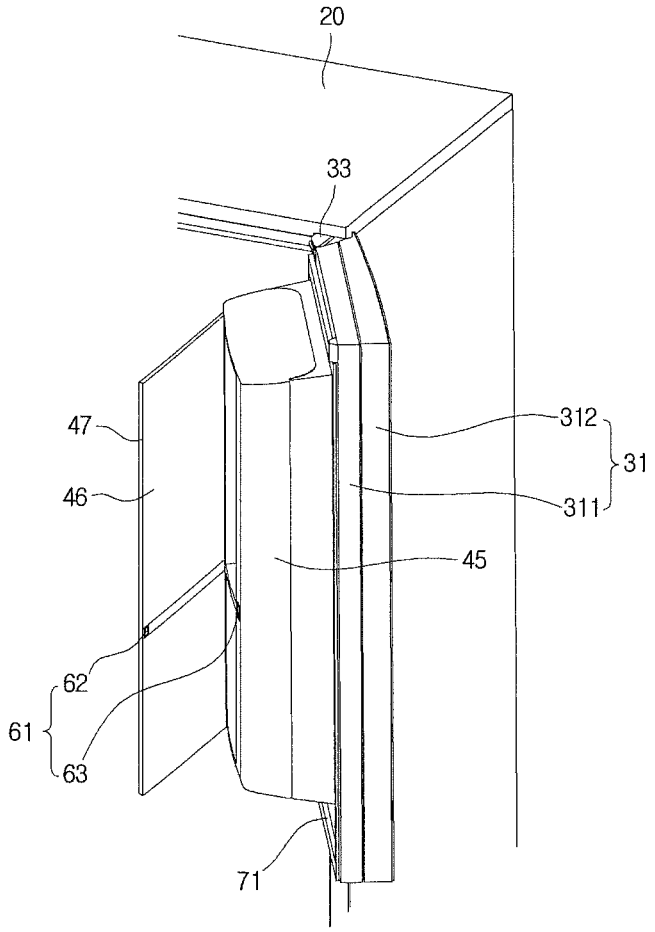

【Figure 3】
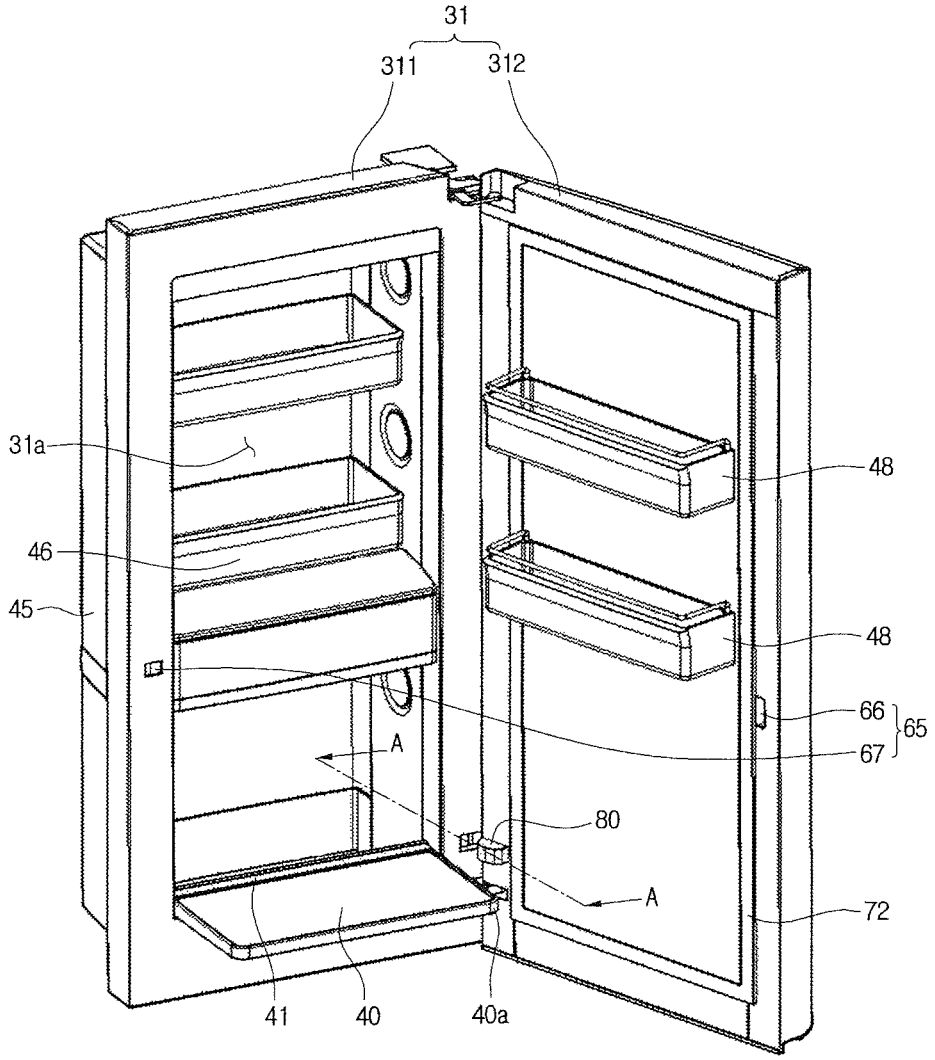

【Figure 4】
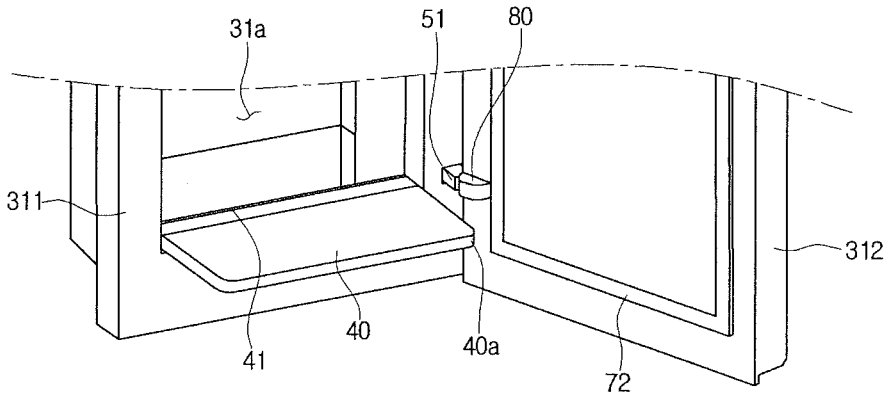
【Figure 5】
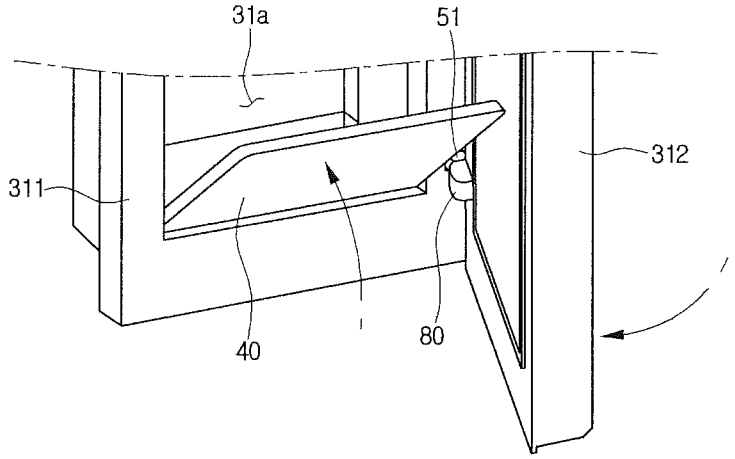
【Figure 6】
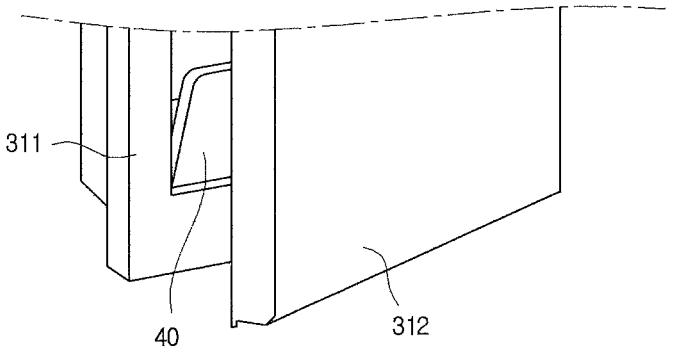

【Figure 7】
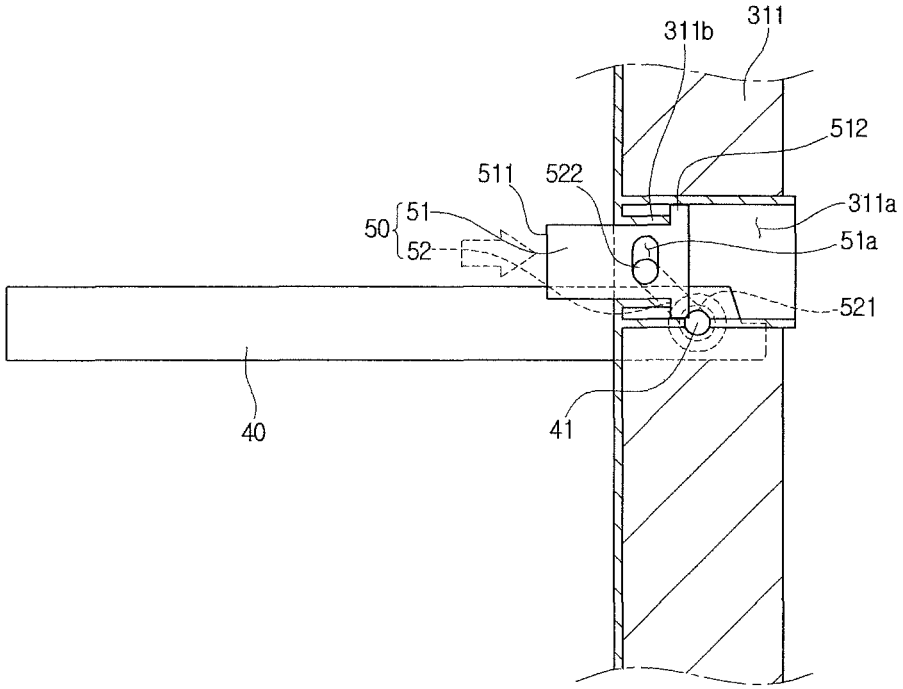

【Figure 8】
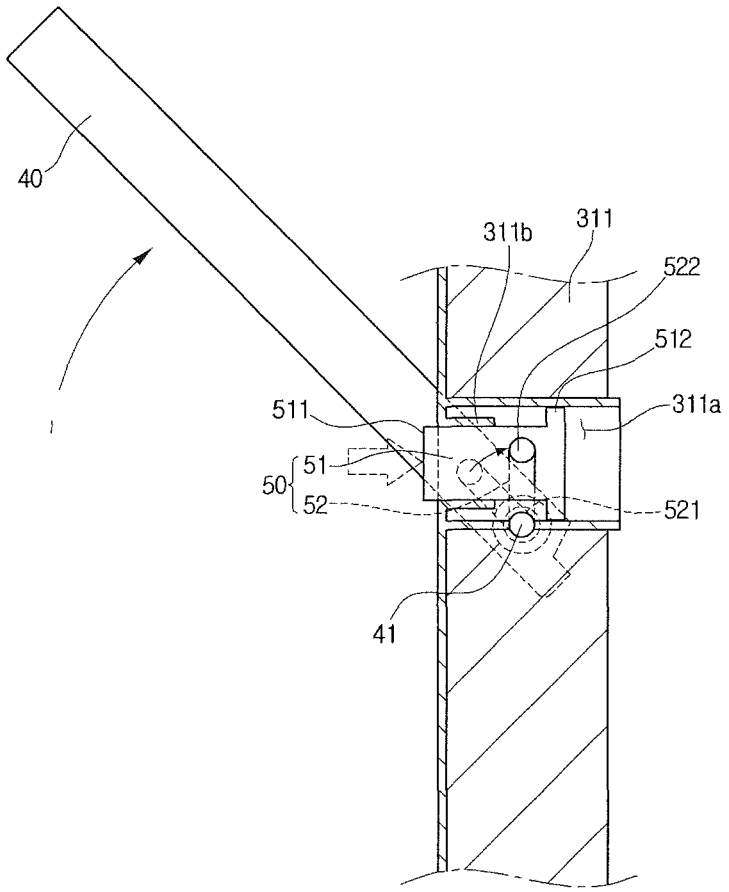

【Figure 9】
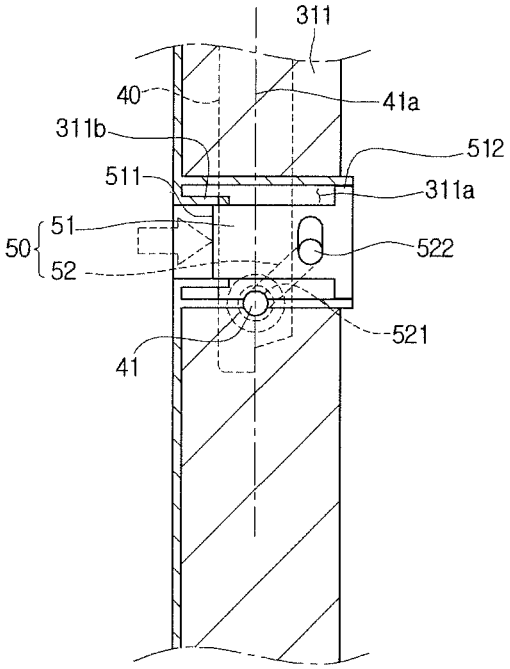
【Figure 10】
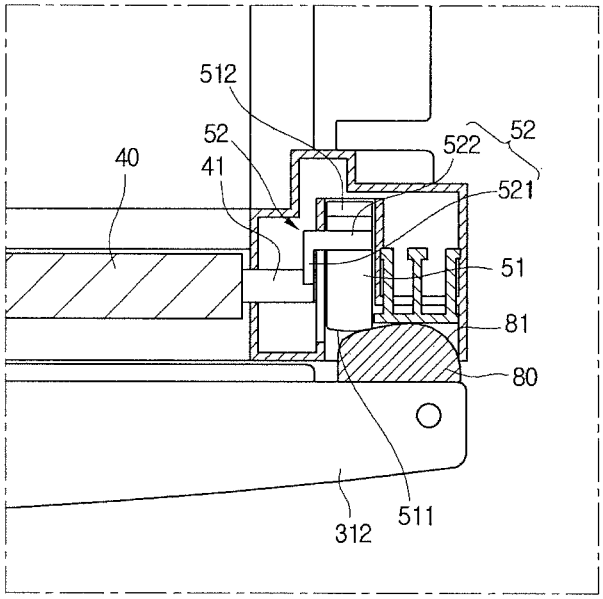

【Figure 11】
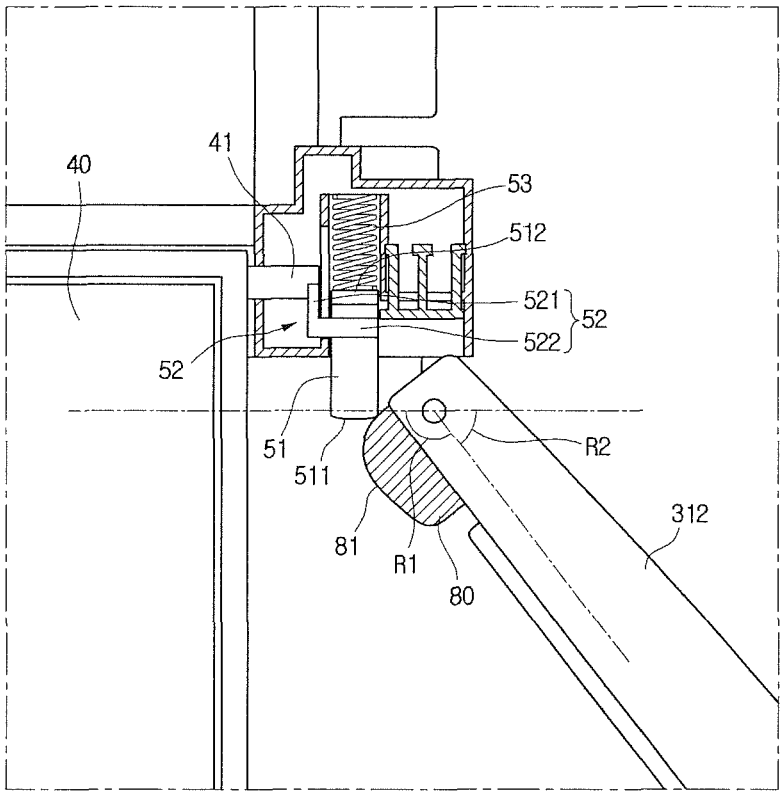

REFRIGERATOR

CROSS REFERENCE TO RELATED APPLICATIONS

This application is a U.S. National Phase Application under 35 U.S.C. § 371 of International Application PCT/KR2015/011036, filed on Oct. 19, 2015, which claims the benefit of Korean Application No. 10-2014-0140653, filed on Oct. 17, 2014, the entire contents of which are hereby incorporated by reference in their entireties.

TECHNICAL FIELD

The present invention relates to a refrigerator.

BACKGROUND ART

Generally, a refrigerator is an apparatus which has a predetermined accommodation space to maintain food, etc. at low temperature, and divides a low-temperature range into a refrigerator compartment maintained at a temperature above zero (Celsius) and a freezer compartment maintained at a temperature below zero.

In more detail, the refrigerator uses cold air generated through heat exchange with a refrigerant circulating according to a refrigeration cycle to cool the refrigerator compartment or the freezer compartment.

Meanwhile, the latest refrigerators are gradually becoming larger and multi-functionalized in accordance with a change in dietary life and a trend of making high-quality products, and various structures and convenience devices in consideration of user convenience and energy efficiency, etc. are being included therein.

For example, at a door of a refrigerator, a storage space capable of storing food, and a home bar door capable of withdrawing the food stored in the storage space without opening the door of the refrigerant may be disposed.

In addition, a refrigerator having a foldable shelf which is capable of loading withdrawn food when the food stored in the refrigerator compartment or freezer compartment is withdrawn while the door of the refrigerator is opened is being launched.

However, since the home bar door and the foldable shelf are connected to each other in the refrigerator of the related art, the shelf moves at the same time when the home bar door moves, causing a beverage container, etc. on the shelf to fall.

RELATED PRIOR ART

U.S. Pat. No. 8,944,534B
U.S. Pat. No. 8,960,826B
U.S. Pat. No. 8,752,916B

DISCLOSURE

Technical Problem

The present invention is suggested to improve the above problem.

Technical Solution

To achieve the above aspect, a refrigerator according to an embodiment of the present invention includes: a cabinet forming a storage space; a first door rotatably coupled to a front surface of the cabinet to open or close the storage space, and having an open portion formed therein; a second door rotatably connected to the first door at a front surface of the first door; a shelf rotatably mounted in the open portion; and a connection module provided in the first door and connected to a rotary shaft of the shelf to enable the shelf to be unfolded forward when the second door is opened and to stand to be folded when the second door is closed.

In addition, the connection module may include a connection part connected to the rotary shaft of the shelf to integrally rotate with the rotary shaft of the shelf, and a moving part connected to the connection part and moving forward or backward when the connection part rotates.

Advantageous Effects

A refrigerator according to the present invention can prevent a shelf from moving by a second door after the second door opens an accommodation space.

In addition, unfolding the shelf and opening the second door can occur simultaneously and automatically when a user presses the second door once.

Furthermore, when the second door is closed, the shelf can be folded toward the accommodation space at the same time.

DESCRIPTION OF DRAWINGS

FIG. 1 is a perspective view of a refrigerator according to an embodiment of the present invention.

FIG. 2 is a partial perspective view of a state in which a door of a refrigerator compartment of a refrigerator in FIG. 1 is open.

FIG. 3 is a perspective view of a state in which a second door is opened at a first door of the refrigerator in FIG. 1.

FIGS. 4 to 6 are views illustrating a process in which a shelf is folded when the second door in FIG. 3 is closed toward the first door.

FIG. 7 is a cross-sectional view taken across line A-A in FIG. 3.

FIGS. 8 and 9 are views illustrating an operational relation between a connection module and shelf in FIG. 7.

FIGS. 10 and 11 are views illustrating an operational relation between a shelf and connection module installed at the first door of the refrigerator in FIG. 1, and a pressing protrusion installed at the second door of the refrigerator in FIG. 1.

MODE FOR INVENTION

Hereinafter, a refrigerator according to an embodiment of the present invention will be described with reference to the accompanying drawings.

FIG. 1 is a perspective view of a refrigerator according to an embodiment of the present invention, FIG. 2 is a partial perspective view of a state in which a door of a refrigerator compartment of a refrigerator in FIG. 1 is open, and FIG. 3 is a perspective view of a state in which a second door is opened at a first door of the refrigerator in FIG. 1.

Referring to FIGS. 1 to 3, a refrigerator 10 according to an embodiment of the present invention may include a cabinet 20 and a door 30.

In the cabinet 20, storage spaces 20*a* and 20*b* in which food, etc. are stored is formed. In addition, the storages spaces 20*a* and 20*b* may be defined as a refrigerator compartment 20*a* and a freezer compartment 20*b*, and the refrigerator compartment 20*a* and the freezer compartment 20*b* may be vertically disposed.

The door 30 may include a refrigerator compartment door 31 for covering the refrigerator compartment 20*a*, and a freezer compartment door 32 for covering the freezer compartment 20*b*.

In addition, a storage module 45 may be installed at the refrigerator compartment door 31, and a separate storage space 31*a* divided from the refrigerator compartment 20*a* may be formed in the storage module 45.

A plurality of baskets 46 may be disposed in the shape of a pocket in the storage module 45, and a beverage container, or food, etc. may be stored therein.

Meanwhile, the storage space 31*a* may be opened toward the outside separately from the refrigerator compartment 20*a*.

In more detail, the refrigerator compartment door 31 may include a first door 311 for opening or closing the refrigerator compartment 20*a*, and a second door 312 for opening or closing the storage space 31*a*. Also, the second door 312 may be opened to open the storage space 31*a* when the refrigerator compartment 20*a* is closed by the first door 311.

In addition, a blocking door 47 for separating the refrigerator compartment 20*a* from the storage space 31*a* may be disposed at the storage module 45. The blocking door 47 may be rotatably installed at the storage module 45 to selectively open the storage space 31*a* toward the refrigerator compartment 20*a*. Since the blocking door 47 separates the refrigerator compartment 20*a* from the storage space 31*a* while the first door 311 is closed and the storage space 31*a* is opened toward the outside by the second door 312, cold air in the refrigerator compartment 20*a* may be prevented from leaking to the outside through the storage space 31*a*.

The first door 311 may be rotatably connected to the cabinet 20 by a door hinge 33 installed at upper and lower ends of an edge of one side thereof consequently, the refrigerator compartment 20*a* may be opened or closed in accordance with rotation of the first door 311. In addition, a first sealer 71 may surround an edge of a rear surface of the first door 311 and come in contact with an edge of a front surface of the cabinet 20 when the first door 311 is closed to prevent the leakage of cold air. The first sealer 71 is formed of a material which is elastically deformable to be compressible. In addition, a magnet is disposed inside the first sealer 71 to enable the first sealer 71 to come in close contact with the front surface of the cabinet 20 by a magnetic force.

While the refrigerator compartment 20*a* is opened by the rotation of the first door 311, the blocking door 47 may also rotate and open the storage space 31*a*. Consequently, a user may open the refrigerator compartment 20*a* and the storage space 31*a* at the same time.

A first locking unit 61 may be disposed at the blocking door 47 and the storage module 45 to maintain a state in which the blocking door 47 is closed toward the storage module 45. The first locking unit 61 may include a first latch hook 62 and a first latch slot 63. The first locking unit 61 may enable the first latch hook 62 to be locked to or unlocked from the first latch slot 63 by a user?s manipulation of pressing and releasing the blocking door 47.

In more detail, when the user closes the blocking door 47 while the blocking door 47 is open, the first latch hook 62 is inserted into the first latch slot 63 and the blocking door 47 remains closed. In addition, when the user presses and releases the blocking door 47 while the blocking door 47 is closed, the first latch hook 62 is detached from the first latch slot 63 and the blocking door 47 is opened. In addition, an elastic member such as a torsion spring (not shown) is wound around a hinge which becomes a rotary shaft of the blocking door 47 to enable the first latch hook 62 to automatically rotate by an elastic force of the elastic member and the storage space 31*a* to be opened when the first latch hook 62 is detached from the first latch slot 63.

Meanwhile, one or more door baskets 48 may be mounted on a rear surface of the second door 312, and the one or more door baskets 48 are accommodated in the storage space 31*a* while the second door 312 comes in close contact with the first door 311, i.e., while the second door 312 is closed. The one or more door baskets 48 may accommodate food, etc., and be disposed between the baskets 46 of the storage space 31*a* when the second door 312 is closed. In other words, to prevent the baskets 46 disposed in the storage space 31*a* and the one or more door baskets 48 of the second door 312 from interfering with each other, the one or more door baskets 48 may be disposed between vertically adjacent two baskets 46. As another method, a front-rear directional width of the one or more door baskets 48 may be designed as a length in which rear surfaces of the one or more door baskets 48 remain spaced apart from the front surfaces of the baskets 46 when the second door 312 is closed. Then, it is fine even if the one or more door baskets 48 and the baskets 46 are disposed at the same height, and a number of mountable door baskets 48 increases.

In addition, a second sealer 72 may surround an edge of the rear surface of the second door 312 to enable the second door 312 to come in contact with an edge of a front surface of the first door 311 when the second door 312 is closed. Similar to the first sealer 71, the second sealer 72 may be formed of a material such as rubber or silicone which is elastically deformable to be compressible. The second sealer 72 comes in close contact with the front surface of the first door 311 while the second door 312 is closed to prevent cold air in the storage space 31*a* from leaking to the outside through the second door 312.

A second locking unit 65 may be disposed between the second door 312 and the first door 311 to maintain a state in which the second door 312 is closed toward the first door 311. The second locking unit 65 may include a second latch hook 66 and a second latch slot 67. The second locking unit 65 may enable the second latch hook 66 to be locked to or unlocked from the second latch slot 67 by a user?s manipulation of pressing and releasing a front surface of the second door 312. Since a configuration and function of the second locking unit 65 are the same as those of the first locking unit 61, an overlapping description with regard to the operation of the first locking unit 61 will be omitted.

Meanwhile, the refrigerator 10 may include a shelf 40 rotatably mounted on the first door 311. The shelf 40 may rotate toward the outside (or front) of the storage space 31*a* while having a horizontal axis as a center of rotation and maintain a horizontally unfolded state. In this state, food or a beverage container, etc. may be placed on an upper surface of the shelf 40.

In more detail, the shelf 40 may be mounted on the first door 311 to be rotatable toward the outside of the storage space 31*a*, may remain folded while the second door 312 is closed, but may rotate toward the outside of the storage space 31*a* and be unfolded when the second door 312 is opened.

In other words, operations of the shelf 40 and the second door 312 may be interlocked with each other. The interlocking between the operation of the shelf 40 and the operation of the second door 312 may be performed by a connection module 50 to be described below.

In addition, the shelf 40 may be mounted on a lower side of the first door 311, i.e., a lower end portion of the storage space 31*a*, to enable a user to easily put a beverage container, etc. thereon. In addition, one corner 40*a* of the shelf 40 may be rounded in a predetermined curvature to prevent the shelf 40 from interfering with the rear surface of the second door 312 when the second door 312 is opened.

FIGS. 4 to 6 are views illustrating a process in which a shelf is folded when the second door in FIG. 3 is closed toward the first door, FIG. 7 is a cross-sectional view taken across line A-A in FIG. 3, and FIGS. 8 and 9 are views illustrating an operational relation between a connection module and shelf in FIG. 7.

Referring to FIGS. 4 to 9, the refrigerator 10 may include the connection module 50.

The connection module 50 selectively connects the second door 312 to a rotary shaft 41 of the shelf 40. Consequently, when the second door 312 rotates in a direction of opening the storage space 31*a*, the shelf 40 may rotate toward the front of the refrigerator 10 and be horizontally unfolded. Also, when the second door 312 rotates in a direction of closing the storage space 31*a*, the shelf 40 may rotate upward and be vertically folded by the connection module 50.

The connection module 50 may be mounted in the first door 311 and include a moving part 51 and a connection part 52. The moving part 51 is installed such that a front surface 511 thereof is horizontally movable toward the inside and outside of the first door 311.

In more detail, a guide hole 311*a* for guiding the moving part 51 to be slidable is formed at one side of the first door 311, and the front surface 511 of the moving part 51 is able to move toward the inside and outside of the first door 311 in accordance with the guide hole 311*a*. In other words, the moving part 51 is installed in the first door 311 to be slidable in front and rear directions of the refrigerator 10.

In addition, a slot 51*a* into which a bent end 522 of the connection part 52 is inserted is formed in the moving part 51. The slot 51*a* is vertically formed in a predetermined length, and may enable the bent end 522 of the connection part 52 to vertically move when the connection part 52 rotates. A length of the slot 51*a* may be formed in a length corresponding to a vertical distance connecting a point when the shelf 40 is horizontal to a point when the shelf 40 is vertical.

An extending end 521 of the connection part 52 is fixed to the rotary shaft 41 of the shelf 40, and the bent end 522 is fitted into the slot 51*a* of the moving part 51. The extending end 521 extends from the rotary shaft 41 in a direction perpendicular to the rotary shaft 41. In addition, the bent end 522 may be bent 90? at an end portion of the extending end 521 such that the connection part 52 is formed in an L-shape. In addition, as the moving part 51 moves forward and backward by the rotation of the second door 312, the bent end 522 rotates along an arc-shaped trajectory having a length of the extending end 521 as a radius of curvature and the rotary shaft 41 as the center. In other words, when the connection part 52 rotates, an end portion of the bent end 522 vertically moves along the slot 51*a*.

In addition, when the second door 312 rotates in a closing direction, the front surface 511 of the moving part 51 which is exposed to the outside of the guide hole 311*a* is pressed by a pressing protrusion 80 which protrudes from an edge of the rear surface of the second door 312 and inserted into the guide hole 311*a*. Here, the bent end 522 of the connection part 52 rotates while moving from a lower end to an upper end of the slot 51*a* when the slot 51*a* horizontally moves backward. In addition, the extending end 521 of the connection part 52 rotates the rotary shaft 41 of the shelf 40, thereby the shelf 40 is folded after rotating from a horizontal state to a vertical state.

Conversely, when the second door 312 rotates in an opening direction, the moving part 51 rotates the connection part 52 in the opposite direction while moving forward, and the rotary shaft 41 of the shelf 40 also rotates as the connection part 52 rotates, thereby the shelf 40 is unfolded in the horizontal state from the vertical state.

Specifically, when the moving part 51 moves forward, the bent end 522 rotates while moving from the upper end to the lower end of the slot 51*a*. In addition, the extending end 521 and the rotary shaft 41 rotate together as the bent end 522 rotates, thereby the shelf 40 is unfolded in the horizontal state from the vertical state.

FIGS. 10 and 11 are views illustrating an operational relation between a shelf and connection module installed at the first door of the refrigerator in FIG. 1, and a pressing protrusion installed at the second door of the refrigerator in FIG. 1.

Referring to FIGS. 10 and 11, the pressing protrusion 80 protrudes from the rear surface of the second door 312, and is designed to press the front surface 511 of the moving part 51. The pressing protrusion 80 may be a part of the second door 312, or a separate independent member may be provided by being coupled to the second door 312.

A pressing surface of the pressing protrusion 80 is formed in a gently rounded shape to prevent the front surface 511 of the moving part 51 from being damaged, and enable the moving part 51 to smoothly move in a horizontal direction.

In addition, as the pressing surface 81 is rounded, a force of the moving part 51 pushing the pressing protrusion 80 may be dispersed throughout the pressing protrusion 80, and noise generated as the pressing surface 81 slides while coming in contact with the front surface 511 of the moving part 51 may be reduced.

Here, an elastic member 53 exerting a force pushing the moving part 51 forward is mounted on a rear surface of the moving part 51. Although the elastic member 53 is not shown in FIGS. 7 and 8, the elastic member 53 is mounted on a structure.

The elastic member 53 remains reduced when the second door 312 is closed, i.e., when the shelf 40 is folded, and as the elastic member 53 rotates in a direction in which the second door 312 is opened, the elastic member 53 pushes the moving part 51 forward while being stretched by a restoration force. As a result, the front surface 511 of the moving part 51 always comes in contact with the pressing surface 81 of the pressing protrusion 80 and presses the pressing surface 81.

Meanwhile, rotation sections R1 and R2 in which the second door 312 rotates may be divided into a first rotation section R1 and a second rotation section R2.

The first rotation section R1 is a section in which the second door 312 comes in contact with the connection module 50. Consequently, when the second door 312 moves in the first rotation section R1, the pressing surface 81 of the pressing protrusion 80 may come in contact with the front surface 511 of the moving part 51, and the shelf 40 may be folded or unfolded.

The second rotation section R2 is a section in which the second door 312 is spaced apart from the connection module 50. Even when the second door 312 moves in the second rotation section R2, the shelf 40 is able to maintain a horizontal state since the pressing surface 81 of the pressing protrusion 80 is spaced apart from the front surface 511 of the moving part 51.

Consequently, when a user uses the shelf 40, food or a container, etc. placed on the shelf 40 does not fall even if the second door 312 moves within the second rotation section R2 since the shelf 40 does not move.

As another example to enable the shelf 40 to be unfolded toward the front when the second door 312 rotates in a direction of opening the storage space 31*a*, the shelf 40 may form a predetermined angle from a vertical surface 41*a* passing along the rotary shaft of the shelf 40 while completely folded. In other words, a center of mass of the shelf 40 may be formed in front of the vertical surface 41*a* to generate a torque caused by a load of the shelf 40 while the shelf 40 is completely folded. Then, a separate elastic member 53 does not have to be mounted behind the moving part 51.

As still another method for enabling the moving part 51 to move forward when the second door 312 rotates in the direction of opening the storage space 31*a*, an elastic member such as a torsion spring may be mounted on the rotary shaft of the shelf 40. Specifically, a restoration force of the torsion spring may act in a direction enabling the shelf 40 to rotate forward when folded. Then, the rotary shaft 41 of the shelf 40 rotates by the restoration force of the torsion spring when the second door 312 is opened, and the moving part 51 will move forward as a result.

In addition, the moving part 51 may further include a stopper 512.

The stopper 512 may be disposed at the moving part 51, and may come in contact with a contact member 311*b* formed in the guide hole 311*a* of the first door 311 and limit rotation of the shelf 40 while the shelf 40 is unfolded toward the outside and in a horizontal state. As another method for limiting the rotation of the shelf 40, a limiting protrusion may protrude from one side of an inner circumferential surface of the guide hole 311*a* and an outer circumferential surface of the moving part 51, and a limiting groove which accommodates the limiting protrusion to limit a moving distance of the limiting protrusion may be formed at the other side thereof.

In addition, the refrigerator 10 may further include a damper (not shown). The damper (not shown) may be disposed at one of the stopper 512 and the contact member 311*b*, and mitigate a contact impact when the stopper 512 comes in contact with the contact member 311*b*.

According to another embodiment of the present invention, a connection module may include a pinion gear installed at the rotary shaft 41 of the shelf 40, and a rack gear installed at the first door 311 to be movable toward the inside and outside of the first door 311, and engaged with the pinion gear to rotate the pinion gear. In addition, a front surface of the rack gear comes in close contact with the pressing surface 81 of the pressing protrusion 80, causing the rack gear to move forward and backward in accordance with a direction in which the second door 312 rotates.

Hereinafter, operational relations among the second door 312, the connection module 50, and the shelf 40 will be described with reference to FIGS. 4 to 10.

First, an operation of the shelf 40 when the second door 312 opens the storage space 31*a* will be described.

When the second door 312 is locked by the second locking unit 65 and closed, the pressing protrusion 80 installed at the rear surface of the second door 312 continues to press the moving part 51. Here, the second door 312 is unlocked from the second locking unit 65 when a front surface of the second door 312 is pressed and released, causing the second door 312 to open the storage space 31*a* while rotating.

In addition, as the second door 312 is opened, the shelf 40 rotates forward and is horizontally unfolded by the restoration force of the elastic member 53 or an eccentric center of mass of the shelf 40.

Since the rotary shaft 41 of the shelf 40 is connected to the connection part 52 and the moving part 51, the bent end 522 of the connection part 52 pushes the front surface 511 of the moving part 51 toward the outside of the guide hole 311*a* while rotating when the rotary shaft 41 of the shelf 40 rotates. Here, the front surface 511 of the moving part 51 presses the pressing protrusion 80 formed at the rear surface of the second door 312 and facilitates opening of the second door 312.

Next, an operation of the shelf 40 when the second door 312 closes the storage space 31*a* will be described.

When the shelf 40 is unfolded, the second door 312 is positioned in the second rotation section R2. In addition, when the second door 312 rotates in the closing direction by a user, the second door 312 enters the first rotation section R1.

Here, the pressing protrusion 80 comes in contact with the front surface 511 of the moving part 51 when the second door 312 enters the first rotation section R1, and presses the front surface 511 of the moving part 51 in the first rotation section R1.

When the front surface 511 of the moving part 51 is pressed, the bent end 522 of the connection part 52 moves from the lower end of the slot 51*a* toward the upper end thereof while rotating by the slot 51*a*. Since the extending end 521 of the connection part 52 is fixed and connected to the rotary shaft 41 of the shelf 40, the extending end 521 rotates the rotary shaft 41 of the shelf 40, and the shelf 40 is stood toward the storage space 31*a*.

In other words, in the refrigerator 10, when a user rotates the second door 312 to close the storage space 31*a*, the shelf 40 may be folded toward the inside of the storage space 31*a* at the same time.

The invention claimed is:

1. A refrigerator comprising:

a cabinet configured to form a storage space;

a first door rotatably coupled to a front surface of the cabinet to open or close the storage space, and having an open portion formed therein;

a second door rotatably connected to the first door at a front surface of the first door;

a shelf rotatably mounted in the open portion; and a connection module provided in the first door and connected to a rotary shaft of the shelf to enable the shelf to be unfolded forward when the second door is opened and to stand to be folded when the second door is closed, wherein the connection module comprises:

a connection part connected to the rotary shaft of the shelf to integrally rotate with the rotary shaft of the shelf; and a moving part connected to the connection part and configured to move forward and backward when the connection part rotates.

2. The refrigerator according to claim 1, wherein the connection part comprises:

an extending end configured to extend from the rotary shaft of the shelf in a direction crossing the rotary shaft of the shelf; and a bent end bent at an end portion of the extending end and connected to the moving part, wherein a slot into which the bent end is inserted is formed to extend in a length in the moving part.

3. The refrigerator according to claim 2, further comprising a pressing protrusion configured to protrude from a rear surface of the second door corresponding to a position where the moving part is formed, and wherein a front surface of the moving part selectively comes in contact with the pressing protrusion.

4. The refrigerator according to claim 3, wherein a pressing surface with which the front surface of the moving part comes in contact is formed at the pressing protrusion, and wherein the pressing surface is formed in a gently rounded shape.

5. The refrigerator according to claim 3, wherein a rotation section which rotates to open or close the second door comprises:

a first rotation section in which the moving part maintains a state of coming in close contact with the pressing protrusion; and a second rotation section in which the moving part is separated from the pressing protrusion.

6. The refrigerator according to claim 1, further comprising an elastic member disposed behind the moving part to exert a force which pushes the moving part forward.

7. The refrigerator according to claim 1, wherein a guide hole configured to accommodate the moving part is formed at the first door, and wherein the connection module further comprises a limiting member formed at the moving part and the guide hole to limit a forward moving distance of the moving part.

8. The refrigerator according to claim 7, wherein the limiting member comprises:

a contact member configured to protrude from an inner circumferential surface of a front end portion of the guide hole; and a stopper configured to protrude from an outer circumferential surface of the moving part to be caught to the contact member.

9. The refrigerator according to claim 8, further comprising a damper provided at one of the contact member and the stopper to mitigate an impact generated when the stopper comes in contact with the contact member.

10. The refrigerator according to claim 1, wherein the shelf defines an angle forward from a vertical plane passing along the rotary shaft of the shelf, and wherein a center of mass of the shelf is disposed in front of the vertical plane based on the shelf being folded.

* * * * *